United States Patent [19]

Kienhöfer

[11] 4,455,851

[45] Jun. 26, 1984

[54] SWAGING MACHINE

[75] Inventor: Klaus Kienhöfer, Niefern-Öschelbronn, Fed. Rep. of Germany

[73] Assignee: Gebr. Felss, Konigsbach-Stein, Fed. Rep. of Germany

[21] Appl. No.: 465,442

[22] Filed: Feb. 10, 1983

[30] Foreign Application Priority Data

Feb. 17, 1982 [DE] Fed. Rep. of Germany ..... 3205585

[51] Int. Cl.[3] ..... B21J 13/02

[52] U.S. Cl. ..... 72/76; 72/402

[58] Field of Search ..... 72/76, 402, 433

[56] References Cited

U.S. PATENT DOCUMENTS 4,255,642 3/1981 Livera ..... 72/76

FOREIGN PATENT DOCUMENTS 1018699 10/1957 Fed. Rep. of Germany ..... 72/402

2529649 1/1977 Fed. Rep. of Germany ..... 72/76

*Primary Examiner*—Lowell A. Larson

*Attorney, Agent, or Firm*—Balogh, Osann, Kramer, Dvorak, Genova & Traub

[57] ABSTRACT

This invention relates to a swaging machine which preferably comprises depth-setting wedges which are adapted to be inserted parallel to the axis of the machine between the swaging dies and the die-actuating rams associated with said dies and which permit the use of the machine for recess swaging. Each die and the die-actuating ram associated with said die have parallel bores and a U-shaped spring is inserted into said bores to connect said die and ram. This arrangement will ensure that the opening defined by the dies will be held open even if a machine provided with such depth-setting wedges operates at a low speed or is at a standstill.

5 Claims, 3 Drawing Figures

SWAGING MACHINE

Figure 1:
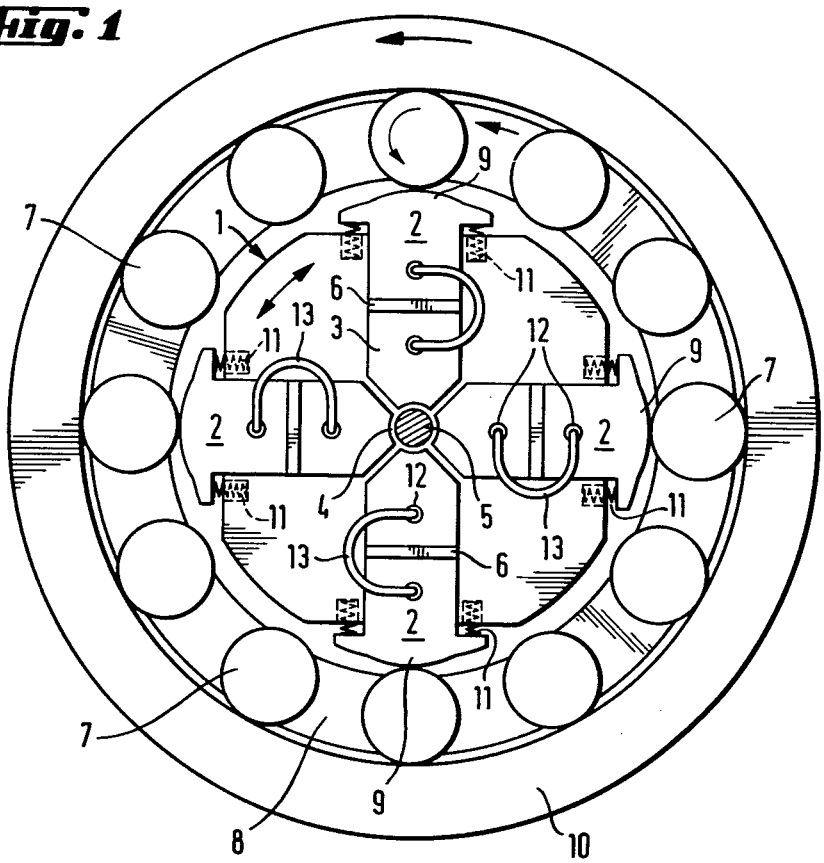

This invention relates to a swaging machine preferably comprising depth-setting wedges for the use of the machine for recess swaging. These wedges are disposed between each die and the ram for actuating the die and are displaceable parallel to the axis of the machine by means of depth-setting flange and on which said wedges are detachably mounted.

Known swaging machines comprise radially guided dies which are oscillated to reduce the cross-section of rod or tube stock as the latter is fed.

It is also known that for recess swaging the oscillation of the dies can be superimposed by a radial depth-setting movement of the dies toward the stock. For this purpose, wedges are inserted between the die-actuating rams and the dies in a direction which is parallel to the axis of the machine. These wedges are displaced by means of a displaceable depth-setting flange, in which said wedges are movably hung so that they can follow the oscillation of the dies and, if desired, can impart to the dies the depth-setting movement toward the stock.

In those of such swaging machines which have a die-actuating shaft that rotates at low speed or is stationary and a revolving outer race, the lack of centrifugal force during the introduction of the workpiece into the opening defined by the dies may have the result that the dies fall radially inwardly to close said opening. It is known that this can be prevented in that the die-actuating rams are urged radially outwardly by springs engaging the heads of such rams and in that the replaceable dies are positively retained on said rams, e.g., by means of clamping members or clamping claws. These measures cannot be adopted if the swaging machines are provided with depth-setting wedges, which permit the machine to be used for recess swaging, because in that case the dies must be radially movable relative to the die-actuating rams.

In swaging machines having two dies, it is known to provide springs between the dies so that the dies and the die-actuating rams are jointly held open. But such springs are highly liable to be soiled and to break. Such machines cannot be used in swaging machines having more than two dies.

It is an object of the invention to provide a swaging machine in which the dies are radially movable relative to the die-actuating rams and which is provided with means for urging the dies radially outwardly in order to prevent an inadvertent closing of the opening defined by the dies.

In a swaging machine comprising dies spaced around a path for a workpiece or stock to be swaged and die-actuating rams spaced around said dies and radially aligned with respective ones of said dies and radially movable relative to said path and to said dies, that object is accomplished in that each die and the die-actuating ram radially aligned with said die are formed with parallel bores and a plurality of U-shaped springs are provided, each of which has two legs, which respectively extend into the bores of an associated die and of the die-actuating ram which is radially aligned with said die. The legs of said springs are slightly curved so that the free ends of said legs are in frictional engagement with said bores and each die and the associated die-actuating ram will be positively held together.

Figure 2:
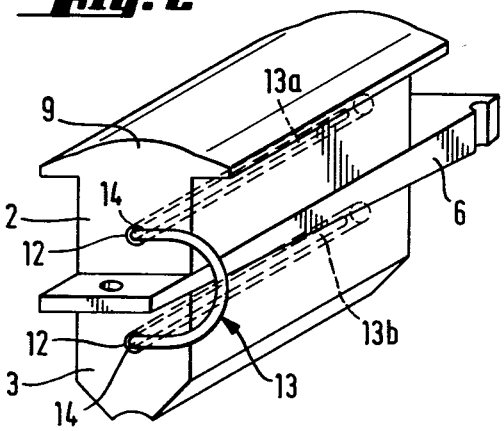
Figure 3:
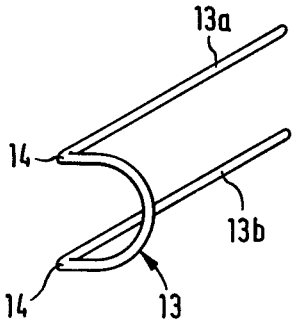

Further details of the invention are apparent from the accompanying drawing, which shows a preferred illustrative embodiment of a swaging machine comprising depth-setting wedges and in which FIG. 1 is a front elevation showing a swaging mechanism, FIG. 2 is a perspective view showing a diaactuating ram, the associated die, and a depth-setting wedge extending between said ram and die and FIG. 3 shows the associated U-shaped spring.

As is apparent from the drawing the swaging mechanism comprises a die-actuating shaft 1 provided with die-actuating rams 2 and dies 3, which define an opening 4 through which the workpiece or stock 5 which is to be swaged is advanced. Depth-setting wedges 6 are disposed between the dies 3 and the rams 2 and are displaceable parallel to the axis of the machine. The rams 2 are surrounded by a circular series of pressure-applying rollers 7, which are disposed in a cage 8 and revolve in an outer race 10 and during a rotation of the shaft 1 act on the heads 9 of the rams 2. In different embodiments, the outer race 10 rather than the shaft 1 might be rotated or the shaft 1 and the outer race 10 might rotate in the same sense at different speeds or in opposite sense. The relative rotational movement of the shaft 1 and the outer race 10 results in an oscillating motion of the rams 2 of the dies 3. By means of the depth-setting wedges 6, a radial depth-setting movement can be superimposed on said oscillating motion of the dies. Such swaging machines are known to comprise two, three or four dies.

Springs 11 are provided, which bear on the heads 9 of the die-actuating rams 2 to urge the latter radially outwardly even when the machine is running at low speed or is at a standstill so that there is no or only an inadequate centrifugal force. Even when the depth-setting wedges 6 have been inserted between each die 3 and the associated die-actuating ram 2, an inadvertent closing of the dies 3 is prevented by the provision of a plurality of U-shaped springs 13, each of which has two legs **13*a* and 13*b*, which extend into respective parallel bores 12 formed in each die 3 and in the die-actuating ram 2 associated with said die. The legs 13*a* and 13*b* are slightly curved so that their free ends are in frictional contact with the dies 3 and rams 2 in said bores and each die 3 and the associated die-actuating ram 2 will be positively held together. The two legs 13*a* and 13*b* of each spring 13 are connected by a bight, which is angled from the legs 13*a*, 13*b* so as to clear the path of the depth-setting wedge 6 which extends between the die 3 and the associated die-actuating ram 3**.

What is claimed is:

1. In a swaging machine which defines a path for a workpiece to be swaged and comprises a plurality of dies, which are spaced around and radially movable with respect to said path, a plurality of rams, which are spaced around said path and radially outwardly of and radially aligned with respective ones of said dies and radially movable with respect to said path and to said dies, die-actuating means operable to oscillate said dies radially with respect to said path with the aid of said rams, and ram-biasing means urging each of said die-actuating rams radially outwardly, the improvement residing in that each of said dies and said die-actuating ram which is radially aligned with said die are formed with respective bores, which are parallel to each other, and a plurality of U-shaped springs are provided, each of which has two legs, which extend into respective ones of said bores formed in one of said dies and in the die-actuating ram which is radially aligned with said die.

2. The improvement set forth in claim 1 as applied to a swaging machine comprising a plurality of depth-setting wedges, which are spaced around and extend along said path, each of said wedges having a small end portion and a large end portion and being movable along said path to insert said small end portion between one of said dies and the die-actuating ram which is radially aligned with said die and thus to control the extent to which said die is movable toward said path by said die-actuating means and to permit the use of the machine for recess swaging.

3. The improvement set forth in claim 1, wherein said legs are curved so that their free ends are in frictional contact with said dies and die-actuating rams and each of said dies and the die-actuating ram radially aligned with said die are positively held together by said spring.

4. The improvement set forth in claim 2, wherein each of said springs has a bight, which connects said legs and is angled from said legs to clear the path of said depth-setting wedge associated with the die and the die-actuating ram which are associated with said spring.

5. In a swaging machine which defines a path for a workpiece to be swaged and comprises a plurality of dies, which are spaced around and radially movable with respect to said path, a plurality of rams, which are spaced around said path and radially outwardly of and radially aligned with respective ones of said dies and radially movable with respect to said path and to said dies, die-actuating means operable to oscillate said dies radially with respect to said path with the aid of said rams, and ram-biasing means urging each of said die-actuating rams radially outwardly, the improvement residing in that each of said dies and the die-actuating ram radially aligned with said die are connected by resilient restraining means yieldably urging said die radially outwardly.

* * * * *